United States Patent [19]

Koch

[11] Patent Number: 4,835,992

[45] Date of Patent: Jun. 6, 1989

[54] METHOD AND APPARATUS FOR THE TREATMENT OF CONTINUOUSLY MOVING TUBULAR FABRIC IN THE WET STATE

[75] Inventor: Werner Koch, Wald-Michelbach, Fed. Rep. of Germany

[73] Assignee: Bruckner Apparatebau GmbH, Fed. Rep. of Germany

[21] Appl. No.: 72,349

[22] Filed: Jul. 10, 1987

[30] Foreign Application Priority Data

Jul. 18, 1986 [DE] Fed. Rep. of Germany ..... 3624406

[51] Int. Cl.[4] ..... D06B 3/36

[52] U.S. Cl. ..... 68/13 R; 68/22 R; 68/177; 68/178; 26/75; 26/80

[58] Field of Search ..... 68/13 R, 22 R, 177, 68/178, 62; 26/74, 75, 80

[56] References Cited

U.S. PATENT DOCUMENTS 3,508,286 4/1970 Rosen ..... 26/80 X
3,580,015 5/1971 Horie et al. ..... 68/177 X
3,631,692 1/1972 Garzotto ..... 68/178 X
3,686,905 8/1972 Stanway ..... 68/177 X
4,077,766 3/1978 von der Eltz ..... 68/178 X

FOREIGN PATENT DOCUMENTS 0174488 3/1986 European Pat. Off. ..... 26/75

*Primary Examiner*—Frankie L. Stinson
*Attorney, Agent, or Firm*—Sheldon & Mak

[57] ABSTRACT

The invention relates to a method and apparatus for the treatment of continuously moving tubular fabric (1) in the wet state, in which this tubular fabric is deliberately expanded in an expansion zone (3) by blowing air in and the fabric width (WB) effectively obtained is measured. The actual value obtained for the fabric width is compared with a predetermined theoretical value and in the event that they differ a correction value is formed and the quantity of air blown into the tubular fabric is controlled as a function of this correction value. The tubular fabric (1) is expanded immediately after wet treatment and is then delivered to the expansion zone free of tension and with a sealing material store. In this way a compact apparatus is achieved which functions simply and reliably.

7 Claims, 2 Drawing Sheets

Figure 1:
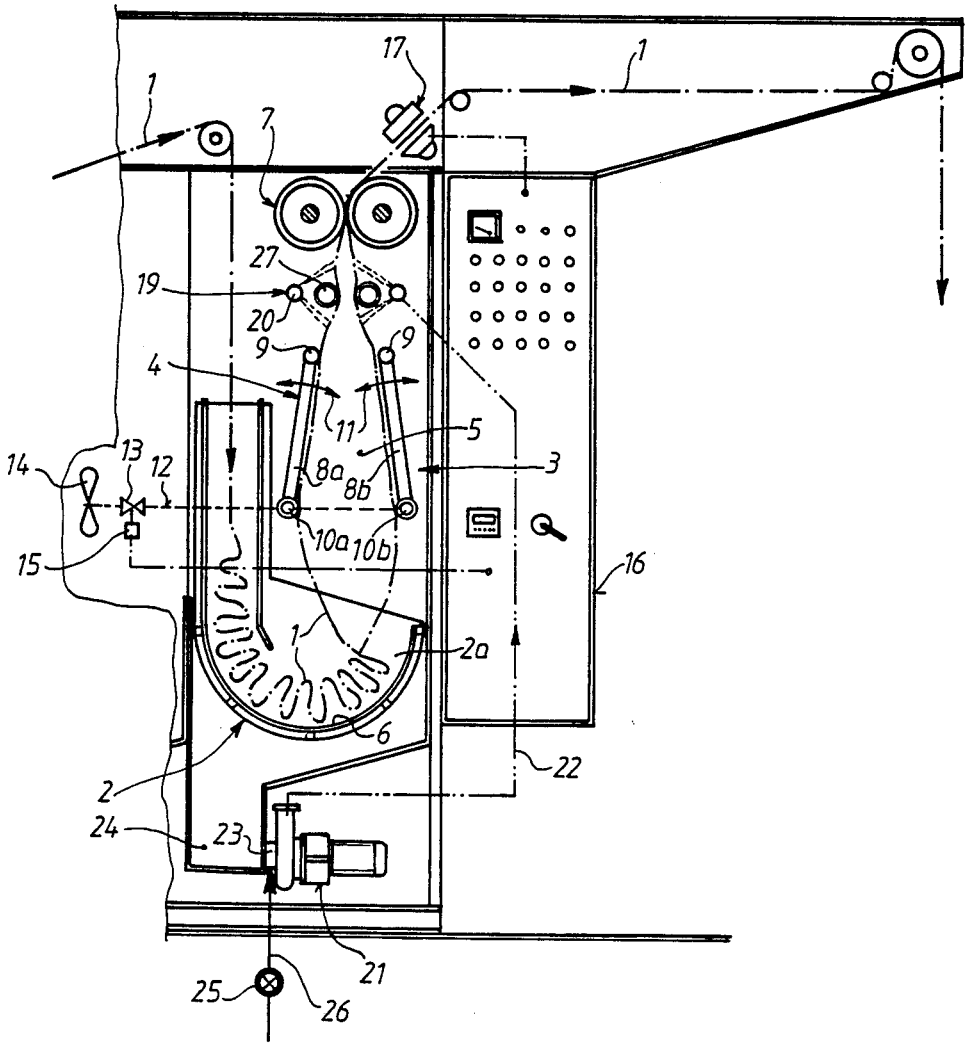

WB 18
18
17
1
28
7
1a
1
16
3
5
29
15
9
9
12
13

METHOD AND APPARATUS FOR THE TREATMENT OF CONTINUOUSLY MOVING TUBULAR FABRIC IN THE WET STATE

The invention relates to a method of treatment of continuously moving tubular fabric in the wet state according to the preamble to claim 1. The invention also relates to apparatus for carrying out this method.

A method and apparatus of the type referred to are known from German Patent Specification No. A-34 33 701. In this case an expansion zone is sealed at the beginning and end by a pair of rollers in each case, one roller of each pair being capable of being driven and regulated. In order to be able to expand or over-expand tubular fabric depending upon the breadth thereof measured after the expansion zone by blowing air in, the speed of delivery and/or removal of the tubular fabric is regulated via the speed of the driven rollers. In contrast to the other known constructions which operate with mechanical expansion means, a very uniform expansion of the tubular fabric is achieved in the aforementioned manner without impairing the surface (by mechanical arrangements).

The object of the present invention is to provide a further method of the type set out in the preamble to claim 1 which gives equally uniform expansion and gentle treatment of the tubular fabric and is distinguished by a particularly compact and simple construction of the apparatus for carrying out this method.

This object is achieved according to the invention by the features set out in the characterising portion of claim 1.

Since in the method according to the invention the tubular fabric is over-expanded at the last stage of a wet treatment, and thus the expansion zone with the balloon-like inflation of the tubular fabric is arranged at that point, there is a considerable saving of space by comparison with a separate expansion zone. Both this and the comparatively simple construction of the appertaining apparatus are also favoured by the fact that the wet tubular fabric is delivered in a sufficient quantity from the last wet treatment stage to the beginning of the expansion zone, the stock of material always present there ensuring a sufficient sealing of the tubular fabric against the escape of air, and the tubular fabric can be delivered completely free of tension to the beginning of the expansion zone and can also be removed from there without tension and delivered to the actual expansion zone.

The desired simplification is also aided in an extremely advantageous manner by using the correction value obtained in the comparison of theoretical value and actual value as the correction output signal so that in the expansion zone the quantity of air sprayed into the tubular fabric can be controlled in terms of a correction of the breadth of the tubular fabric which is found to be necessary.

When the method is carried out in practice, the expansion zone can be provided for example immediately after or above a last washing section, impregnation section or other wet treatment section, and it can also be advantageous to treat the material in the wide tubular state and deliver it thus to the beginning of the expansion zone.

In addition, the tubular fabric can be guided at the end of the expansion zone in a manner which is known per se through a gap between the squeezer rollers so as to remove water from it and flatten it. In this way the tubular fabric can not only have water constantly removed from it through a continuously-operating wet treatment apparatus and an expansion zone with widthways stretching but can also have water continuously removed from it in its finished width without stopping the wet treatment apparatus.

It is also advantageous, particularly with the method described last above, if chemicals are applied in measured quantities to the wet tubular fabric on all sides just before the gap between the squeezer rollers. The main chemicals to be applied are softeners, but other additional chemicals can be applied. This means that the application of chemicals to the wet tubular fabric can take place in one operation with the wet over-expansion and removal of water from this tubular fabric and during its continuous further transport. It should be noted in this connection that experts in the art were previously of the opinion that an accurate application of chemicals or softeners could only be carried out with a differential moisture content, i.e. the amount of solution introduced into a corresponding application section must be smaller than the amount of solution discharged, the corresponding quantity of chemicals for application being contained in this differential moisture content. Because of this it was not possible to remove a large quantity of water from the tubular fabric in such known constructions. Although in the method according to the invention the majority of the chemicals for application are removed again during squeezing, the tests on which the invention is based have shown that the application of chemicals, particularly softeners, just before the gap between the squeezer rollers leads to markedly better results (higher application yield) by comparison with the known methods.

Apparatus for carrying out the method according to the invention contains the features set out in the preamble to claim 3 and is distinguished by the features set out in the characterising portion of this claim 3.

Figure 2:
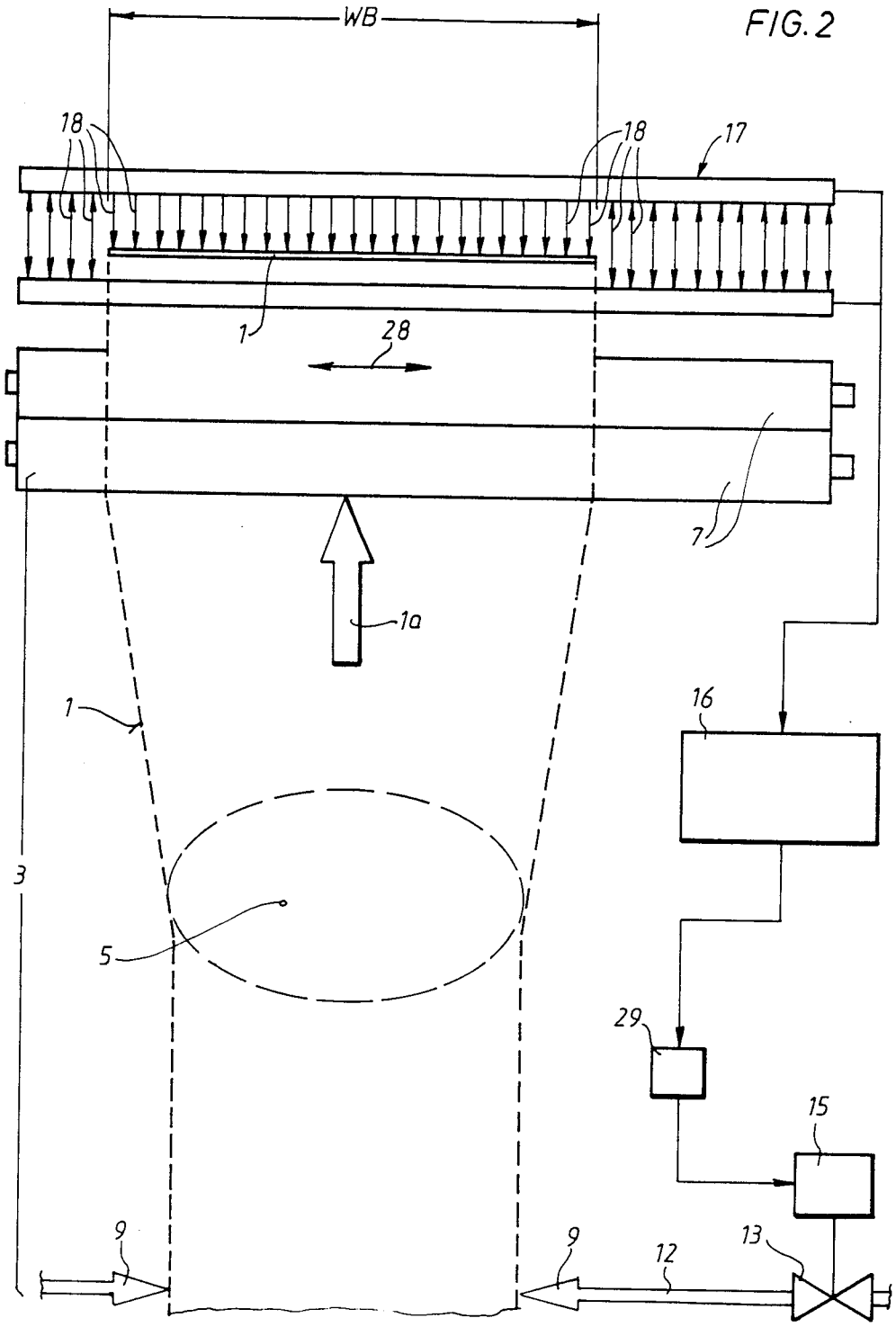

Further details and advantages of the invention are set out in the other subordinate claims. The invention will be explained in greater detail below with the aid of the drawings, in which:

FIG. 1 shows a simplified schematic side view of the outlet part of wet treatment apparatus with directly associated expansion zone;

FIG. 2 shows a greatly simplified flow diagram of tubular fabric in the region of the expansion zone and a width measuring arrangement, to explain the method of operating the apparatus according to FIG. 1. In the embodiment illustrated in FIG. 1 the apparatus for the wet treatment of continuously moving tubular fabric 1 is arranged directly on the outlet part of a suitable wet treatment apparatus of which only the last wet treatment section 2 is shown for the sake of clarity, this wet treatment section 2 being constructed in this case in the shape of a boot as is known per se, but if required it can be constructed in any other suitable manner.

In the treatment apparatus according to the invention an expansion zone 3 is provided immediately above the open lower end 2*a* of the boot, and in this expansion zone 3 compressed air is sprayed into the wet tubular fabric with the aid of a nozzle arrangement 4 which will be explained in greater detail below, thus inflating the tubular fabric 1 like a balloon—as indicated by the air pocket 5—and deliberately over-expanding it. In order to be able to maintain the air pocket 5 in the desired manner the expansion zone 3, which is essentially vertically aligned, is sealed at the beginning and end, i.e. at the upper and lower end, so that essentially none of the compressed air blown into the wet tubular fabric 1 can escape outwards. It should also be mentioned in general terms in this connection that a certain proportion of the compressed air which has been introduced can always escape again out of the air pocket 5 through the material—depending upon the pore size and the fluid content—but that with regulated delivery of the compressed air the balloon width of the air pocket or the width of the tubular fabric can be constantly regulated. The delivery of the compressed air and the control thereof will be dealt with in greater detail below.

In the embodiment illustrated in FIG. 1 the lower end 2*a* of the boot shape which forms a transition region between the lasts wet treatment section 2 and the expansion zone 3 contains a sliding grate 6 which is preferably constructed as a plastic sliding grate, advances the wet tubular fabric 1 without tension and forms a material store immediately below the expansion zone 3, as is indicated in FIG. 1 by the tubular fabric 1 which is compressed into folds in the lower end of the boot 2*a*. Thus at the lower end of the expansion zone 3 this material store on the sliding grate 6 at the same time forms a lower sealing point against escape of air from the tubular fabric 1. By contrast, at the upper end of the expansion zone 3 the upper sealing point is formed by a pair of squeezer rollers 7 of a construction which is known per se. The air pocket 5 which is formed inside the tubular fabric 1 by blowing in compressed air and is maintained continuously is thus defined in its vertical longitudinal extent at the lower end by the seal on the part of the material store and the upper end of the part of the pair of squeezer rollers 7.

The nozzle arrangement 4 which is provided for blowing compressed air into the tubular fabric 1 can basically be constructed and arranged in any suitable way. It is particularly advantageous if—as shown in FIG. 1—this nozzle arrangement has two swivel arms 8*a* and 8*b* arranged on both sides of the tubular fabric 1 with compressed air nozzles 9, between which the tubular fabric 1 is guided, arranged on their free ends and directed towards the tubular fabric 1. Opposite the compressed air nozzles 9 the swivel arms 8*a*, 8*b* which contain the air supply lines to the compressed air nozzles 9 are retained in swivel bearings 10 and 10*b* respectively which are only indicated, so that the swivel arms 8*a*, 8*b* can move in direction of the indicated double arrows 1, and thus on the one hand easy guiding of the inflated tubular fabric 1 inside the expansion zone can be achieved without on the other hand resulting in an undesirable mechanical effect on the outside of the tubular fabric 1 (chafe marks).

The compressed air nozzles 9 are connected via the hollow swivel bearings 10*a*, 10*b* to a compressed air supply line 12 in which a constantly regulating compressed air dosaging valve 13 is provided and which in its turn is connected to a high-performance blower 14 belonging to the nozzle arrangement 4. In the present case a motor with a control regulator 15 is associated with the compressed air dosaging valve 13, and for control purposes the dosaging valve 13 of the nozzle arrangement 4 is connected via this motor with control regulator 15 to a computer 16 of suitable design. A width measuring arrangement 17 is also connected for control purposes to the computer 16 which can be of any suitable design. Thus at the same time the computer 16 connects the width measuring arrangement 17 to the nozzle arrangement 4 or the compressed air dosaging valve 13 thereof in such a way that the action of the compressed air on the nozzle arrangement 4 can be controlled or adjusted as a function of a difference between the measured and the predetermined width of the material.

Any arrangement which acts mechanically, electromechanically or electronically and is suitable for this purpose can be used as a width measuring arrangement 17. However, it is particularly advantageous if this width measuring arrangement is a photoelectronic measuring arrangement 17 operating with a light curtain. As shown in FIG. 2, in such a photoelectronic measuring arrangement 17 the effective width or the actual width of the tubular fabric 1 which is now laid flat again can then be measured exactly behind the expansion zone 3 (behind the pair of squeezer rollers 7 thereof) with the aid of the light curtain which is indicated by arrows 18 if the tubular fabric 1 does not pass centrally between the pair of squeezer rollers 7, i.e. is laterally offset.

In the example according to FIG. 1 the treatment apparatus according to the invention also has an application and spraying arrangement 19 immediately before the gap between the squeezer rollers or the pair of squeezer rollers which forms the gap, and suitable chemicals, for example softeners, can be sprayed onto the tubular fabric 1 by means of the application and spraying arrangement 19 before the tubular fabric passes between the squeezer rollers 7. This application and spraying arrangement 19 contains two spray pipes 20 arranged on both sides of the tubular fabric 1 as well as a circulating pump 21 which is connected on the one hand via a pressure line 22 to the spray pipes 20 and on the other hand via its intake pipe 23 to a fluid collecting arrangement 24 below the wet treatment section 2. A suitably constructed dosaging arrangement 25 for the substances to be applied is also connected to the intake pipe 23 of the circulating pump 21 via a dosaging pipe 26. Two guide rods or guide rollers 27 which are arranged a suitable distance apart and act on the outside of the inflated tubular fabric 1 can be provided in the region of the spray pipe 20, that is to say just before the pair of squeezer rollers 7, in such a way that the tubular fabric 1 running towards the squeezer rollers 7 is already compressed to a certain extent and aligned widthways in order to enable it to pass between the pair of squeezer rollers 7 without creasing.

The construction and arrangement of the treatment apparatus previously described with the aid of the example according to FIG. 1 is extremely compact, simple to construct and overall readily accessible. In this embodiment, moreover, the apparatus represents an extremely favourable combination of three essential treatment processes: The principal type of treatment, namely the wet expansion and widthways stretching of the wet tubular fabric, can be combined in an extremely favorable manner with the removal of water from the tubular fabric (by means of the upper pair of squeezer rollers 7) and with the application of additional chemicals (e.g. softeners or the like) in the region before the squeezer rollers. These three possibilities for treatment can thus be combined in one single continuous operation whilst saving space and using simple designs.

As regards the design and construction there are of course numerous other possible variations within the scope of the invention relating to a number of parts of the apparatus. Thus, for example, in place of the proposed sliding grate 6 (to deliver the tubular fabric 1 and form the material store at the lower end of the expansion zone 3) any other suitable arrangement can be used which fulfils the same purpose, for example a conveyor belt or the like. The association of the compressed air nozzles 9 with the most suitable longitudinal or vertical section of the expansion zone 3 (e.g. arrangement of the compressed air nozzles 9 in the upper or lower half of the expansion zone 3) will depend above all upon the type of preceding wet treatment. Furthermore, for the control of the motor 15 of the compressed air dosaging valve 13, instead of the setting regulator already referred to a suitable converter can be used, for example a so-called I-P converter, by means of which the electrical or electronic control signals coming from the computer 16 are converted into pneumatic control values in order to control the operation of the compressed air dosaging valve 13 in terms of opening or closing or throttling this valve.

The widthways stretching operation of the method according to the invention will be explained below with the aid of the flow diagram according to FIG. 2.

It may be assumed that the tubular fabric 1 is continuously transported at a predetermined speed in the direction of the arrow 1*a* through the expansion zone 3, then through the pair of squeezer rollers 7 and finally through the width measuring arrangement 17. The tubular fabric 1 is for example a circular-knit tubular fabric which is to be deliberately expanded or stretched to a predetermined width (in the state in which it is laid flat again). For this purpose the tubular fabric 1 which is sealed at the beginning and end of the expansion zone 3 against the escape of air is over-expanded in the wet state with the aid of the air pocket 5 which is continuously maintained inside the tube by blowing compressed air into it (tests have shown that wet tubular fabric can be expanded with air to approximately 30% of its width). In the deliberately expanded state the wet tubular fabric 1 passes through the gap between the pair of squeezer rollers 7, retained by the air pocket 5 and water is removed mechanically from the tubular fabric 1. At the same time the tubular fabric 1 is laid flat and completely crease-free in the gap between the squeezer rollers. The fluid which is squeezed out and runs downwards seals the fabric balloon which is formed in the expansion zone 3 (i.e. free spaces between the fibres are closed by the fluid) and thus permits a greater overexpansion of the tubular fabric 1. The fluid is only displaced by air at those points at which compressed air is blown into the interior of the tubular fabric 1 via the compressed air nozzles 9.

In the state in which the tubular fabric 1 is laid widthways, i.e. in its full width W8 achieved by overexpansion, the fabric then passes through the width measuring arrangement 17. In this width measuring arrangement 17 the actual width achieved or the actual value obtained is measured photoelectronically with the aid of a light curtain which is indicated by arrows 18. This has the advantage that the effective fabric width W8 can even be obtained quite accurately when—as indicated in FIG. 2—the tubular fabric 1 does not run quite centrally to the pair of squeezer rollers 7, i.e. runs offset towards one or the other long side (cf. double arrow 28).

The actual value of the fabric width W8 measured in the width measuring arrangement 17 is passed to the computer 16 into which a theoretical value, i.e. the desired fabric width, is fed. The actual value and the theoretical value are then compared with one another in the computer 16. If the computer 16 finds a variation between the actual value and the theoretical value, i.e. if for example the actual value is 500 mm and the predetermined theoretical value is 600 mm, then a corresponding correction value is formed which the computer converts into a correction output signal. This correction output signal is passed to a setting regulator 29 of the motor 15 associated with the compressed air dosaging valve 13 or to a suitable converter (e.g. a so-called I-P converter) so that the quantity of air blown into the tubular fabric 1 (via the compressed air nozzles 9) can be controlled or adjusted in order to achieve the necessary width correction. Thus, for example, if the actual value for the fabric width behind the expansion zone 3 is found to be too small, then the quantity of air to be introduced into the tubular fabric 1 via the compressed air nozzles 9 must be correspondingly increased in order to produce a greater over-expansion of the tubular fabric 1 in the expansion zone 3 and vice versa.

If softener or another chemical is to be applied during this over-expansion of the wet tubular fabric 1 before the removal of water (pair of squeezer rollers 7), then this can take place in the manner described above in connection with FIG. 1 with the aid of the application and spraying arrangement 19. Softener can be added for example in the order of 1–2% of the fabric weight. These application chemicals are advantageously delivered in measured quantities into the intake pipe 23 of the circulating pump 21 (cf. FIG. 1), so that the resulting solution can be applied to the outside of the tubular fabric on both sides or on all sides directly before the gap between the pair of squeezer rollers 7 with the aid of the spray pipes 20.

I claim:

1. An apparatus useful in the wet treatment of a continuously moving wet tubular fabric in a plurality of wet treatment stages, in which:

(i) in an expansion zone having a beginning and an end, compressed air is blown into the wet tubular fabric which has been sealed against the escape of air at the beginning and at the end of the expansion zone, the tubular fabric being deliberately expanded thereby;

(ii) behind the expansion zone, the width of the tubular fabric is measured; and the actual value obtained for the fabric width is compared with a predetermined theoretical value; and in the event of differences between the actual value and the theoretical value, a correction value is formed;

(iii) an adjustment is carried out in the region of the expansion zone as a function of the magnitude of the correction value;

(iv) the tubular fabric is expanded in step (i) directly after the last wet treatment stage, and the wet tubular fabric is delivered from this last wet treatment stage to the expansion zone free of tension and in such a quantity that the beginning of the expansion zone is sealed against the escape of air by the material store; and (v) the correction value obtained from the comparison between the actual value and the theoretical value is converted into a correction output signal which controls the quantity of air blown into the expansion zone in order to achieve the necessary width correction of the tubular fabric; the apparatus comprising:

(a) an expansion zone which is defined by an upper sealing point and a lower sealing point adapted to prevent the escape of air from the tubular fabric, the expansion zone comprising a nozzle arrangement in the region between the upper and lower sealing points;

(b) a width measuring arrangement which is arranged behind the upper sealing point of the expansion zone for the tubular fabric in its flat state;

(c) a transition region disposed between the last wet treatment stage and the expansion zone adapted to form the lower sealing point; and (d) the nozzle arrangement being connected to the width measuring arrangement for control purposes via a computer in such a way that the action of air on the nozzle arrangement can be controlled as a function of the difference between the actual value and the theoretical value of the fabric width.

2. The apparatus of claim 1 wherein the transition region contains a sliding grate capable of advancing the tubular fabric without tension and which forms a material store.

3. The apparatus of claim 1 wherein the width measuring arrangement is a photoelectronic measuring arrangement operating with a light curtain.

4. The apparatus of claim 1 further comprising a control connection between the computer and the nozzle arrangement and a continuously regulating compressed air dosaging valve, the dosaging valve being provided in the control connection and being associated with a converter or setting regulator connected to the computer.

5. The apparatus of claim 1 wherein the nozzle arrangement contains two swivel arms on the free ends of which are mounted compressed air nozzles between which the tubular fabric is guided.

6. The apparatus of claim 1 wherein the upper sealing point of the expansion zone is formed by squeezer rollers and wherein an application and spraying arrangement for spraying chemicals onto the tubular fabric is provided immediately before the squeezer rollers.

7. The apparatus of claim 6 further comprising a circulating pump having inlet and outlet pipes, a fluid collecting arrangement and a dosaging arrangement for applying the chemicals, and wherein the application and spraying arrangement contains two spray pipes arranged on both sides of the tubular fabric; wherein the fluid collecting arrangement is disposed below the last wet treatment stage and wherein the circulating pump is connected on the one hand to the spray pipes and on the other hand to the fluid collecting arrangement and wherein the dosaging arrangement is connected to the inlet pipe of the circulating pump.

* * * * *